United States Patent [19]

Hunt

[11] 4,079,536

[45] Mar. 21, 1978

[54] RELOADING APPARATUS FOR REVOLVERS

[76] Inventor: John M. Hunt, 22747 Lemon St., Lake Elsinore, Calif. 92330

[21] Appl. No.: 761,810

[22] Filed: Jan. 24, 1977

[51] Int. Cl.[2] ..... F42B 39/04

[52] U.S. Cl. ..... 42/89

[58] Field of Search ..... 42/89; 224/13, 15, 20

[56] References Cited

U.S. PATENT DOCUMENTS

| | | | |
|---|---|---|---|
| 2,637,930 | 5/1953 | Mason | 42/89 |
| 2,896,353 | 7/1959 | Hunt | 42/89 |
| 3,769,733 | 11/1973 | Nelson | 42/89 |
| 3,890,733 | 6/1975 | Kubik | 42/89 |

*Primary Examiner*—Charles T. Jordan
*Attorney, Agent, or Firm*—William W. Haefliger

[57] ABSTRACT

Reloading apparatus for a revolver is designed to interfit a cartridge storing can defining a post. The apparatus comprises:

a. a clip in the form of a cup having a bottom wall and an open top, the cup adapted to be finger gripped, b. said bottom wall including resiliently deformable structure defining a plurality of recesses arranged in a circle, each recess sized to receive the butt-end of a revolver cartridge with said structure releasably retaining said butt-ends, c. there being first connector means carried by the bottom wall to axially receive and rotatably and releasably interfit second connector means carried by said post, whereby the cup may be rotatably and releasably attached to the can with the cartridges stored in the can.

13 Claims, 10 Drawing Figures

RELOADING APPARATUS FOR REVOLVERS

BACKGROUND OF THE INVENTION

This invention relates generally to apparatus to assist in reloading of revolvers; and more particularly concerns improvements in interlocking of cartridge holding clips with canisters.

In my prior U.S. Pat. No. 2,896,353 I have disclosed a reloading clip characterized by releasable attachment of the clip to a cartridge storing canister. That attachment, achieved by a crimped lip on the canister, is sometimes less than satisfactory in that it is less positive than desired, and can be inadvertently disconnected.

SUMMARY OF THE INVENTION

It is a major object of the invention to provide an improved interlock of a cartridge clip and canister, characterized in that relative rotation of these elements is necessary to disconnect them; at the same time, very quick disconnection can be achieved, for rapid re-loading. Basically, the apparatus is adapted to interfit a cartridge storing can defining a post, and comprises:

a. a clip in the form of cup having a bottom wall and an open top, the cup adapted to be finger gripped, b. said bottom wall including resiliently deformable structure defining a plurality of recesses arranged in a circle, each recess sized to receive the butt end of a revolver cartridge with said structure releasably retaining said butt ends, c. there being first connector means carried by the bottom wall to axially receive and rotatably and releasably interfit second connector means carried by said post, whereby the cup may be rotatably and releasably attached to the can with the cartridges stored in the can.

Typically, the can has a rim held in interfitting relation with the cup at the bottom wall end thereof, by the interfit of the first and second connectors; the first connector comprises a plate defining an opening to pass the post, and a land on the plate, and the second connector means comprises a flange sized to be rotated into overlying relation with the land after passage through the plate opening; the opening and flange may have triangular configuration so that 60° rotation of the flange effects the interfit; the can has a skirt which form scallops to partially interfit sides of the cartridges upon axial assembly of the cup of the can, and the six cartridges have detent interfit with the skirt characterized in that 60° rotation of the cup in either direction advances the cartridges out of interfit with the scallops and into another position of interfit with the scallops, i.e. in correspondence to rotary locking of the connectors, whereby positive interlock is achieved, with capability for very rapid unlocking.

These and other objects and advantages of the invention, as well as the details of an illustrative embodiment, will be more fully understood from the following description and drawings, in which:

DRAWING DESCRIPTION

DETAILED DESCRIPTION

Figure 1:
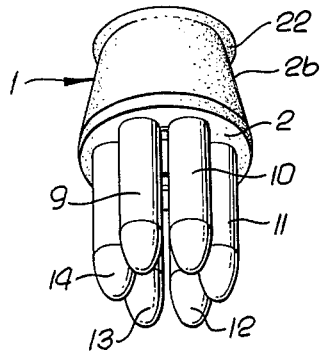
FIG. 1 is a perspective view of a loaded reloading clip for revolvers.
Figure 2:
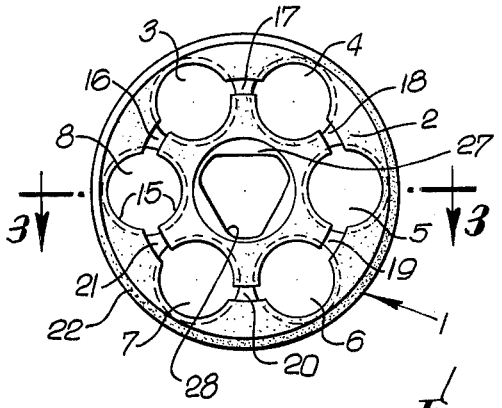
FIG. 2 is an enlarged bottom view of the FIG. 1 clip.
Figure 3:
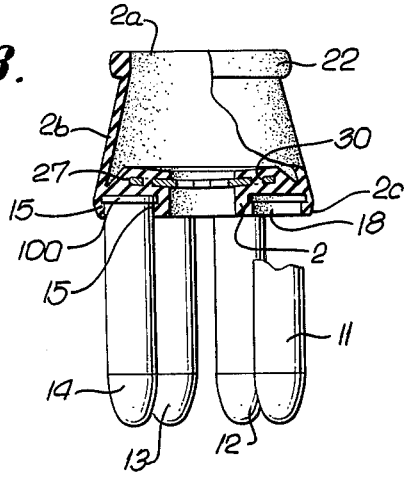
FIG. 3 is a vertical section taken on lines 3—3 of FIG. 2.

Referring first to FIGS. 1–4, the improved reloading clip for revolvers comprises a cup-shaped body 1 which may consist of resilient elastomeric material, as for example rubber. The cup has a flat bottom wall 2, an open top at *2a* and a frusto-conical side wall or skirt *2b*. The flat bottom wall includes resiliently deformable structure defining a plurality of flat-topped circular recesses 3, 4, 5, 6, 7 and 8. Recesses 3 through 8 are arranged in a circle concentric with the bottom of cup 1, as shown, and correspond in number and position of the cartridge chambers of a revolver cyclinder. The flat top of each recess provides a seat for receiving the flanged butt end 100 of a cartridge as seen in FIG. 3. The clip is loaded by inserting into respective ones of the recesses the butt ends of a plurality of cartridges 9, 10, 11, 12, 13 and 14, as shown in FIG. 1.

Each of the cartridge-receiving recesses (recess 8, for example) has a resilient flange 15 extending substantially entirely around its lip, as shown. Resilient flanges 15 are parts of cup 1, and are of the same resilient material, preferably rubber. These flanges underlie and grip the flanged butt ends of cartridges seated in the recesses and securely hold the cartridges in position for instant simultaneous insertion into a revolver cylinder. Because flanges 15 surround substantially the entire base of each cartridge, the cartridges are reliably and securely held in position despite reasonable shaking or dropping of the loaded clip or striking against other objects, such as will occur, for example, when the loaded clips are carried in a coat pocket or the like. However, the resilience of cup 1 and flanges 15 permits easy loading of the clip and also permits the clip to be "peeled" quickly from the cartridges after they have been inserted into the revolver cylinder, as hereinafter more fully explained.

A plurality of grooves 16, 17, 18, 19, 20 and 21 are provided between respective ones of recesses 3 through 8, as shown. Grooves 16 through 21 preferably are short arcuate portions of a single circular groove in the flat outside bottom surface 2 of cup 1. The circular groove is broken into sections by recesses 3 through 8, with which it merges. This circular groove passes through the centers of the cartridge-receiving recesses, and provides in each of the flanges 15 two breaks or gaps substantially at the points nearest the two adjacent recesses.

The depth of the circular grooves is equal to or slightly greater than the depth of flanges 15. The circular groove is especially important in reloading clips for use with revolvers having small cylinders such that the butt-end flanges of cartridges in the revolver cylinder touch or nearly touch one another. The two breaks in each flange keep the resilient flange material from being caught or pinched between adjacent cartridges when the reloading clip is "peeled" off as hereinafter explained. The two breaks in each flange also facilitate loading of the clip.

The open top 2*a* of cup 1 preferably is of somewhat smaller diameter than the bottom of the cup so that the sides of the cup slope inward as shown. The lip of the cup preferably is thickened to form a ring 22 around the top of the cup.

The reloading apparatus is adapted to interfit a cartridge storing canister or can 24 defining a central post 25 integral with the bottom wall 26 of the can.

The bottom wall of the clip carries first connector means to axially receive and rotatably and releasably interfit second connector means carried by the post, whereby the cup may be rotatably and releasably attached to the can, with the cartridges stored in the can.

The first connector means advantageously comprises a plate 27 defining a central opening 28 to pass the end portion 25*a* of the post. The plate has or defines a land or lands 29 to rotatably receive and interfit the second connector means, in retaining relation therewith. Typically, the plate opening has generally triangular shape, whereby three lands 29 are provided adjacent the elongated eges of the opening. Note that the bottom wall of the clip includes an elastomeric annular portion carrying the plate the periphery of which may be embedded in the elastomeric material. If desired, the plate may contain perforations 30 into which elastomeric material is molded to firmly retain the plate while allowing axial resilient flexing with accompanying limited axial displacement of the plate during lock-up.

Figure 10:
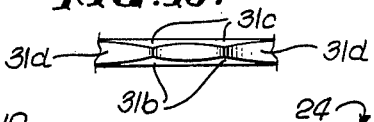
FIG. 10 is an edge view of a flange corner.

The second connector means carried by the post may advantageously have the form of a flange 31 relative to which the land or lands are rotated so as to overlie the land or lands. The opening 28 is sized to closely pass the flange, and the latter may also have polygonal outline, as for example generally triangular form, so that when rotated after passage through the opening the corners of the flange will engage, cam over, interfit, and overlie the lands 29. Sixty degrees of rotation is employed for a generally triangular flange with corners 31*a* as shown. Other angles of rotation can be used for various numbers of cartridges. A threaded fastener 32 retains the flange to the post, and has a domed head 32*a* to "seek" the opening 28 upon assembly. Head 32*a* may be otherwise attached to the post, or integral therewith. Note that the interengagement of the canister rim 33 with the periphery 2*c* of the cup bottom wall limits extension of the flanges 31 through the opening 28 and aids yieldably resilient make-up and inter-locking. Note in FIG. 10 that the flanges may have thicknesses that taper at their outer edges, at 31*b* and 31*c*, to aid in facilitating tool proof and smooth locking and release. Also, a key or locating means 60 may interlock the flange to the post to properly locate the two in fixed azimuth relation. Flange flats are seen at 31*d*.

Figure 5:
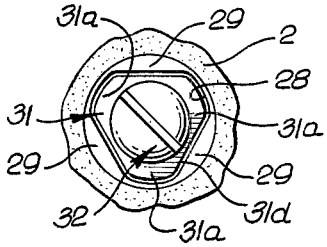
FIG. 5 is an enlarged fragmentary view showing a connector flange carried by the canister being passed by an opening in a plate carried by the clip.
Figure 6:
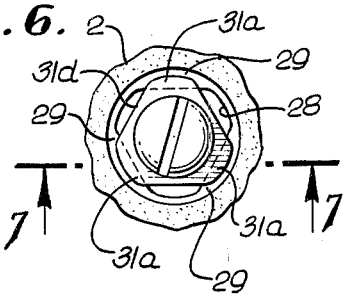
FIG. 6 is a view like FIG. 5, but showing the flange rotated onto a land defined by the plate.
Figure 4:
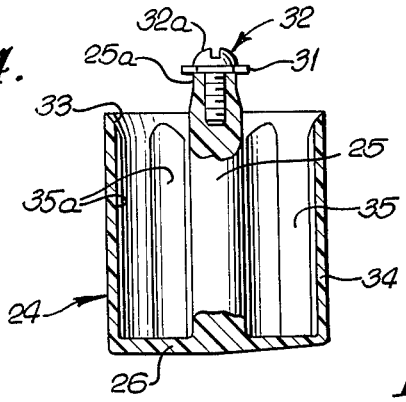
FIG. 4 is a vertical section through a cansiter adapted to receive and store cartridges retained by the FIG. 3 clip.
Figure 7:
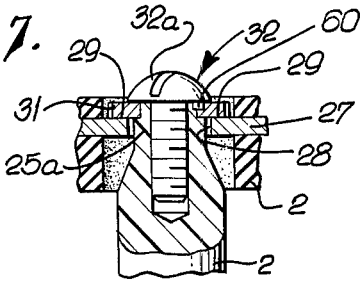
FIG. 7 is an enlarged sectional elevation on lines 7—7 of FIG. 6 showing interfit of the plate land and relatively rotated flange.
Figure 8:
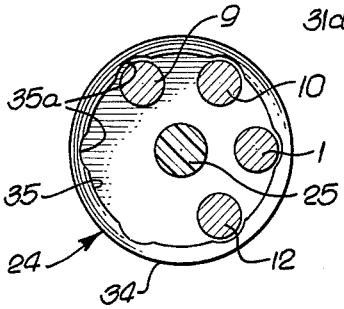
FIG. 8 is horizontal section through the canister, showing cartridges yieldably retained in scallops.

The can 24 has a skirt 34 defining an inner wall 35 which defines or forms axially elongated flutes or scallops 35*a*. The latter are circularly positioned about the post in equally spaced relation to interfit the cartridges 9–14 when the first and second connector means are made up or rotated to interlock the cup and clip. Also, the number of scallops is equal to the number of cartridges. Thus, upon initial axial assembly the cartridges fit into the cup, and partially into the scallops as seen in FIG. 8, the flange and opening being triangularly aligned as seen in FIG. 5. After the clip edge 2*c* engages the cup rim 33, the clip and cup are relatively rotated against resistance offered by engagement of the cartridges against the unscalloped inner wall 35 of the cup skirt; however, after 60° rotation, the cartridges "drop" into the next adjacent scallops, at which time the flange corners overlie the lands 29 as seen in FIG. 6, to provide positive, but yieldable, interlock. The resiliently flexible retention of the cartridges by the flanges 15 tends to yieldably urge the cartridges into the scallops.

When it is desired to re-load, the clip skirt is grasped and quickly rotated 60° in either direction, after which the clip is pulled axially from the cup, the cartridges inserted into the revolver cylinder, and the clip "peeled" off the cartridges.

Figure 9:
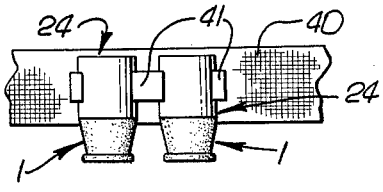
FIG. 9 shows assembled clips and canisters retained on a belt.

FIG. 9 shows assembled clips and cups carried by an ammunition belt 40, with the clips facing downwardly. Retainers 41 on the belt hold the cups in position. Other holders for the cups may be provided, i.e. to provide single, dual or multiple cannnister combination and multiple arrangements of belt and strip attachment and mountings.

I claim:

1. Reloading apparatus for revolvers, and adapted to interfit a cartridge storing can defining a post, said apparatus comprising a. a clip in the form of a cup having a bottom wall and an open top, the cup adapted to be finger gripped, b. said bottom wall including resiliently deformable structure defining a plurality of recesses arranged in a circle, each recess sized to receive the butt-end of a revolver cartridge with said structure releasably retaining said butt-ends, c. there being first connector means carried by the bottom wall to axially receive and rotatably and releasably interfit second connector means carried by said post, whereby the cup may be rotatably and releasably attached to the can with the cartridges stored in the can.

2. The apparatus of claim 1 including said can having a rim held in interfitting relation with the cup at said bottom wall end thereof, by said interfit of the first and second connector means.

3. The apparatus of claim 2 wherein said can has a skirt defining an inner wall which forms scallops to partially interfit said cartridges when the first and second connector means are relatively rotated to complete the interfit thereof.

4. The apparatus of claim 3 including said cartridges having detent interfit with the can skirt characterized in that rotatable release of said first and second connector means is yieldably opposed by interengagement of the cartridges with the skirt inner wall at locations adjacent said scallops.

5. The apparatus of claim 1 wherein said first connector means comprises a plate defining an opening to pass said post, said plate having a land to rotatably receive and interfit said second connector means.

6. The apparatus of claim 5 wherein said bottom wall includes an elastomeric portion carrying said plate.

7. The apparatus of claim 5 wherein said plate opening has generally triangular shape.

8. The apparatus of claim 2 wherein said first connector means comprises a plate defining an opening in which said post is received, said plate having a land to rotatably receive and interfit said second connector means which has the form of a flange overlying said land, said opening sized to pass the flange after rotation of the flange off the land.

9. The apparatus of claim 8 wherein the plate opening has polygonal shape and the flange also has polygonal shape, whereby multiple lands and multiple flange corners are provided.

10. The apparatus of claim 9 wherein three lands and three flange corners are provided.

11. The apparatus of claim 8 including a domed head centrally overlying the flange at the side thereof opposite the post.

12. The apparatus of claim 2 including a holder holding multiple of said cans.

13. The apparatus of claim 9 wherein said flange corners are radially tapered at their upper and lower surfaces.

* * * * *